United States Patent [19]

Nelmark et al.

[11] Patent Number: 4,595,066

[45] Date of Patent: Jun. 17, 1986

[54] APPARATUS FOR HANDLING DRILL PIPES

[75] Inventors: Jack D. Nelmark, New Berlin; James A. Stanke, Greenfield, both of Wis.

[73] Assignee: Becor Western, Inc., So. Milwaukee, Wis.

[21] Appl. No.: 752,663

[22] Filed: Jul. 8, 1985

Related U.S. Application Data

[63] Continuation of Ser. No. 562,210, Dec. 16, 1983, abandoned.

[51] Int. Cl.[4] ..... E21B 19/14

[52] U.S. Cl. ..... 175/85; 175/52; 414/745

[58] Field of Search ..... 175/85, 161, 162, 203, 175/220, 52; 211/60.1; 414/745; 81/57.17, 57.19, 57.2, 57.33; 269/56

[56] References Cited

U.S. PATENT DOCUMENTS

| | | | |
|---|---|---|---|
| Re. 29,541 | 2/1978 | Russell | 175/52 |
| 3,212,593 | 10/1965 | Reischl | 175/85 |
| 3,312,294 | 4/1967 | Wilson | 173/164 |
| 3,336,991 | 8/1967 | Klem et al. | 175/85 |
| 3,500,708 | 3/1970 | Wilson | 81/57.34 |
| 3,599,498 | 3/1970 | Brommel et al. | 175/85 |
| 3,650,339 | 3/1972 | Selfe et al. | 175/85 |
| 3,762,578 | 10/1973 | Cooper et al. | 214/1 |
| 3,844,547 | 10/1974 | Lang et al. | 269/25 |
| 3,860,126 | 1/1975 | Nelmark et al. | 175/85 |
| 3,978,993 | 9/1976 | Howard | 214/2.5 |
| 4,013,178 | 3/1977 | Brown et al. | 214/2.5 |
| 4,117,941 | 10/1978 | McCleskey, Jr. et al. | 214/2.5 |
| 4,128,135 | 12/1978 | Mitchart | 175/52 |
| 4,295,527 | 10/1981 | Rüsse | 175/85 |
| 4,455,116 | 6/1984 | Lindstedt et al. | 414/22 |

*Primary Examiner*—Stephen J. Novosad
*Assistant Examiner*—Bruce M. Kisliuk
*Attorney, Agent, or Firm*—Quarles & Brady

[57] ABSTRACT

An elongated pipe carrier in a blast hole drilling vehicle allows a drill pipe to be more easily connected and disconnected to a drill string in a hole being drilled at an angle. At the lower end of the carrier a receptacle with hydraulically operated doors is secured by a hydraulically operated lock. Near the upper end a gate is pneumatically operated in response to the hydraulic operation of the receptacle lock. Also disclosed are two methods, one for connecting the upper end of the pipe to a drill head, then unlocking and opening the doors of the receptacle, and then connecting a lower end of the pipe to the drill string while supporting the pipe at an angle on the open carrier. In the second method, the receptacle is closed, and is then locked around the lower end of the drill pipe, so that pawls inside the receptacle can block rotation of the pipe in one direction. The pipe is then disconnected from the drill head.

8 Claims, 19 Drawing Figures

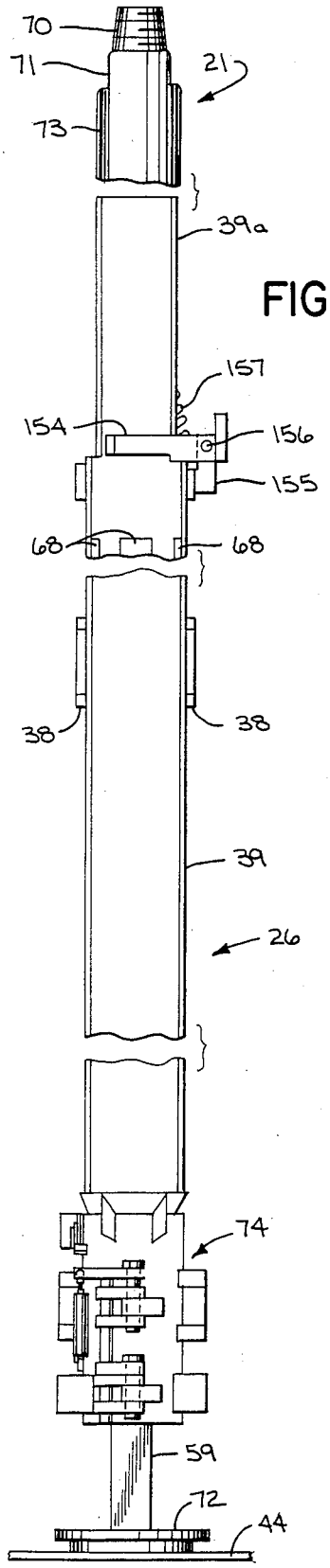
FIG. 3
FIG. 4
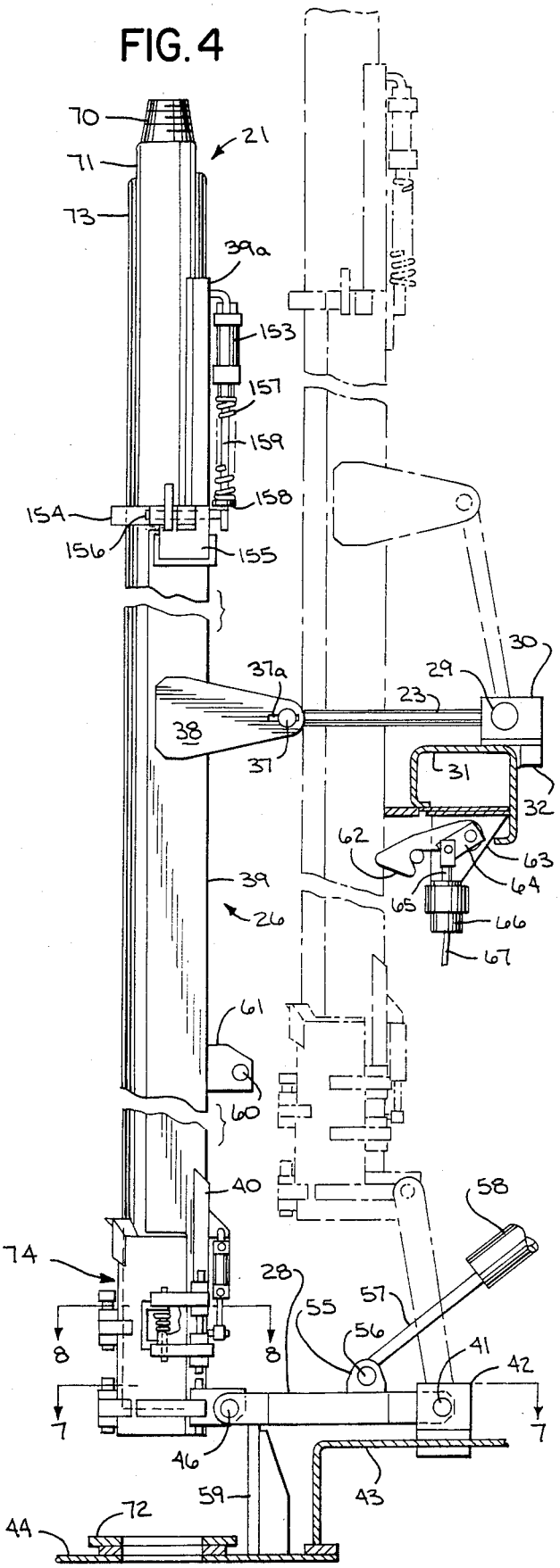

FIG.5
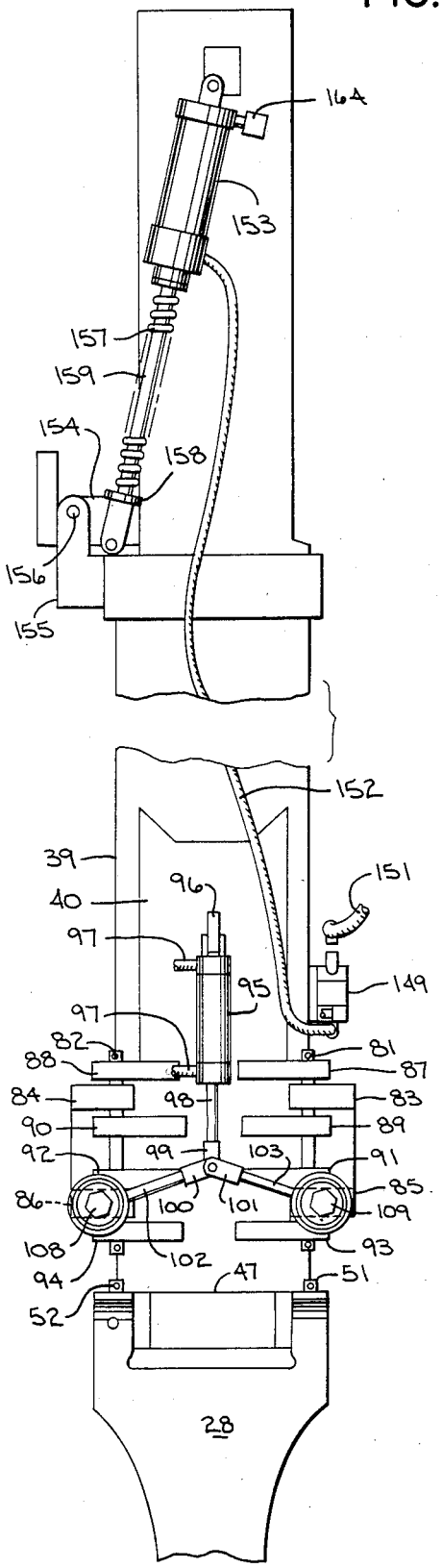
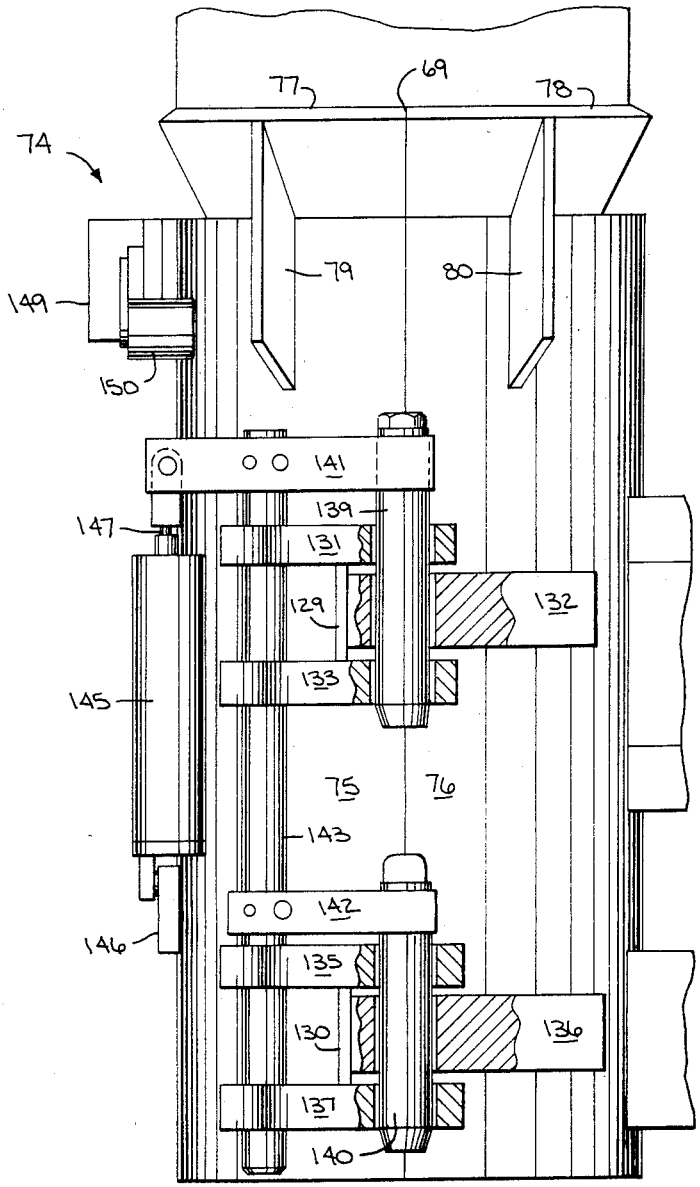
FIG.6

18
21
39
154
153
12
26
74
139
140
95
14
76
75
40
19
17

APPARATUS FOR HANDLING DRILL PIPES

This is a continuation of application Ser. No. 562,210, filed Dec. 16, 1983, now abandoned.

BACKGROUND OF THE INVENTION

1. Field of the Invention

The invention relates to pipe racks of a type used in mobile earth drilling units of various kinds where individually stored pipes are connected in a drill string of several pipes for drilling operations.

2. Description of the Prior Art

A type of drilling equipment known as a blast hole drill is widely used in surface mining and quarrying operations. This equipment is typically mobile—being mounted on a vehicle that travels on crawlers. The vehicle has a cab for operating personnel and a housing for the machinery that drives the unit. A long, pivoting mast is disposed horizontally when the unit is on the move, and is set upright for vertical drilling operations. The mast carries a number of individually stored pipes arranged longitudinally therein. These pipes are connected one at a time in a drill string as a hole is being drilled.

Blast hole equipment is used in surface mining and quarrying operations to drill holes of moderate depth. Explosives are lowered to the bottom of these holes and detonated to break up rock and other hard earth formations. This permits the excavation of the material disintegrated by the blast and allows expansion of the area being mined or quarried.

In certain mining operations it becomes advantageous to position the mast at an angle, up to 30°, for example, to drill a hole at that angle. There is a problem, however, in connecting drill pipes to an angular drill string. If the drilling operation were conducted on the vertical, the top section of pipe would be suspended from a drill head and lowered to connect it at the end of the drill string that projects vertically upward from the hole. When drilling at an angle, a pipe that is connected at its upper end to the drill head will not be suitably supported at its lower end to permit alignment with, and a threading connection to, the drill string.

Pipes have been connected to the drill string with the aid of pipe handling mechanisms in which the pipes are stored. One such mechanism is shown and described in Reischl, U.S. Pat. No. 3,212,593, issued Oct. 19, 1965, and another is shown and described in Nelmark et al, U.S. Pat. No. 3,860,126, issued Jan. 14, 1975. In both of these, each pipe is stored in an individual pipe carrier with a socket at its lower end. In both of these, a pipe must be connected to the drill head, lifted clear of the socket and the pipe carrier must be retracted before the pipe can be connected to the drill string. Conversely, the pipe must be disconnected from the drill string before the pipe carrier can be moved out to receive the pipe. In angle drilling this results in the lower end of the pipe being unsupported by the carrier when being connected to the string, and just after disconnection from the drill string.

SUMMARY OF THE INVENTION

The invention resides in a drill pipe carrier in which the carrier is open to allow the drill pipe to be supported while being connected and disconnected from a drill string in angle drilling operations, and in which the carrier is both closed and locked for connecting and disconnecting the pipe from a drill head.

The drill pipe carrier has an elongated channel member with a trough in which the drill pipe can be supported along its backside when disposed at an angle. A pair of doors that complete a closure around the pipe are pivotally mounted to a lower end of the channel member. The doors have pawls on the inside to oppose rotation of a lower end of the pipe in one direction. The doors also have respective lugs extending laterally along their outer sides and the lugs on one door are interposed between the lugs on the other door when the doors are closed. A securing device is carried by one of the doors for movement into and out of a position coupling the interposed lugs to secure the doors against opening. This allows the drill head to be loosened from the pipe by rotating the pipe in the direction in which the pawls oppose rotation. A first fluid-driven actuator is coupled for actuating the movement of the securing device, and a second fluid-driven actuator is coupled to pivot the doors open and closed when the lugs are not coupled by the securing device.

Thus, the integral socket of the prior art has been replaced by a receptacle with doors that open, close and lock. The locking mechanism is important in preventing the receptacle from opening when the dril head is being connected and disconnected from an upper end of the drill pipe.

Further aspects of the invention concern the fluid circuitry for controlling operation of the drill pipe carrier, the pivoting of the doors and their linkage to the door actuator, as well as the specific construction of the door locking mechanism.

The general object of the invention is to provide improved drill pipe carriers for handling pipes during angle hole drilling operations. Although the general object of the invention relates to angle drilling, the invention may also prove advantageous in vertical drilling operations.

Another object of the invention is to prevent the receptacle of the drill pipe carrier from opening when substantial torque is applied through the drill head to loosen its connection to the upper end of a drill pipe.

Another object of the invention is to provide a drill pipe carrier and associated actuators for retrofitting existing blast hole drilling equipment.

These and other objects and advantages of the invention will appear from the following description in which reference is made to the accompanying drawings which form a part hereof and in which there is disclosed, by way of example, a preferred embodiment of the invention. To distinguish that which is described by way of example from that which is basic to the invention, the invention has been defined in the claims that follow the description.

BRIEF DESCRIPTION OF THE DRAWINGS

FIG. 3 is a front view of a pipe carrier of the present invention that is mounted on the mast of FIG. 1;

FIG. 4 is a right side view of the pipe carrier of FIG. 3 showing its points of attachment to the mast of FIG. 1;

FIG. 5 is a back view of the upper and lower portions of the carrier of FIG. 4;

FIG. 6 is an enlarged detail view of the receptacle at the lower end of the carrier of FIG. 4;

DETAILED DESCRIPTION OF THE PREFERRED EMBODIMENT

Figure 1:
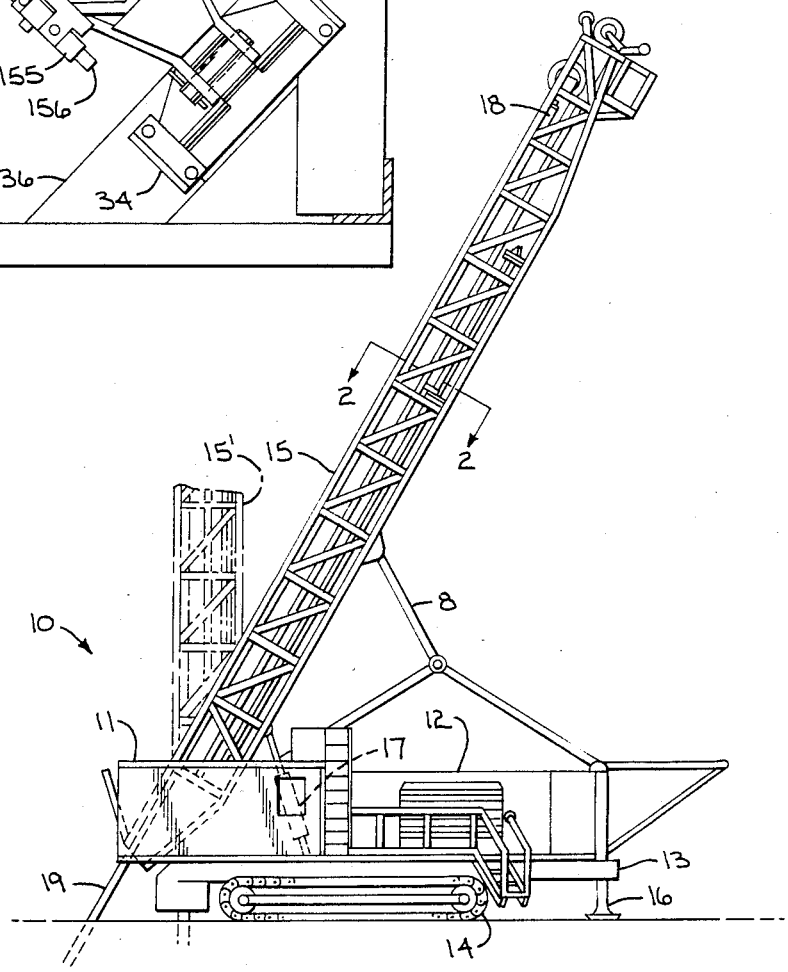
FIG. 1 is a side elevation view of a blast hole drilling unit that incorporates the present invention.

FIG. 1 shows a rotary blast hole drilling unit 10 that includes the preferred embodiment of the invention. The unit 10 has a cab 11 for operating personnel and a machinery housing 12 enclosing the machinery that drives the unit 10. The cab 11 and the machinery housing 12 are supported on a main frame 13 which is carried on a pair of crawlers 14, thereby making the unit mobile. The invention can also be applied to units carried on different mobilizing elements, such as tire-bearing wheels.

Rising upwardly in FIG. 1 is an elongated drilling mast 15, which has been positioned for drilling a hole into the earth at an angle. When moved from place to place, the drilling mast 15 is carried horizontally, along and just above the top of the machinery housing 12. At the drilling site, the unit 10 is stopped, raised off the crawlers 14 and stabilized using at least three leveling jacks 16 such as the one seen at the front end of the unit 10 in FIG. 1. The mast 15 is then raised—very often to a vertical position indicated by the phantom FIG. 15' in FIG. 1. The mast 15 may also be tilted to angular drilling positions in increments of 5° from vertical, up to a maximum of 30° from vertical, which is the position of the mast 15 in FIG. 1. The mast 15 is raised by operation of a hydraulic cylinder 17 (in phantom in FIG. 1) and is supported by a brace 8, which is unfolded as the mast 15 is raised, and which is locked when the mast 15 reaches the desired position. Such a brace is disclosed in Lang et al, U.S. Pat. No. 3,805,463 issued Apr. 23, 1974.

The mast 15 is an open lattice structure with a back and two sides. The equipment carried in the mast, other than the apparatus of the present invention, is described and illustrated in Reischl, U.S. Pat. No. 3,212,593. To briefly summarize, there are two opposing tracks (not shown in FIG. 1) extending longitudinally inside the mast 15, and a drill head 18 seen in FIG. 1 is driven up and down along these tracks. The drill head 18 is raised and lowered along the tracks by a pair of chains (not shown) extending longitudinally within the mast 15. The chains engage sprockets which carry rotating pinions that engage a pair of racks on opposite sides of the drill head 18. The drill head 18 carries a rotatable coupling (not shown) with a downwardly opening, threaded socket that attaches to an upper end of a drill pipe. The drill head 18 also carries one or more motors (not shown) to rotatably drive the coupling and all pipes attached thereto. The motors may be electric, hydraulic or pneumatic.

Figure 2:
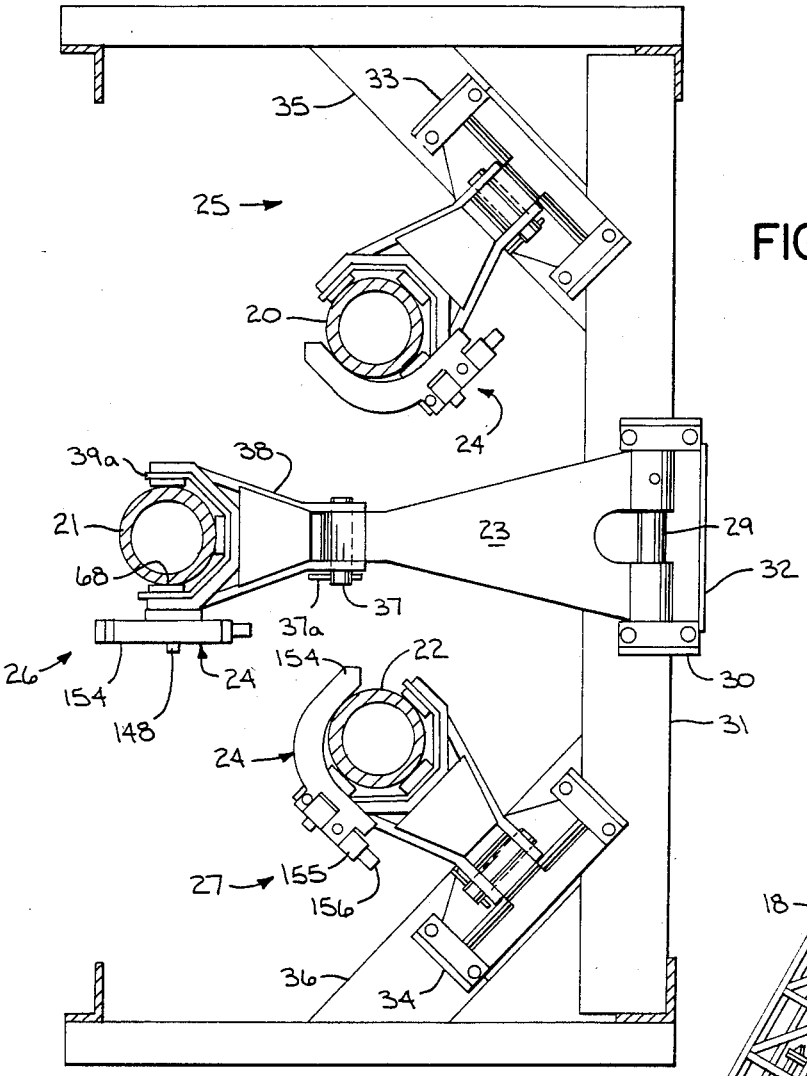
FIG. 2 is a sectional view through the mast of the blast hole drilling unit in FIG. 1 taken in the plane indicated by lines 2—2 in FIG. 1.

Depending on the depth of the hole being drilled in FIG. 1, a drill string 19 of from one to three pipes 20, 21 and 22 which are seen in the sectional view, FIG. 2, can be connected to the drill head 18. Each pipe 20, 21 and 22 is stored in a respective pipe carrier, so that there are three pipe carriers 25, 26 and 27 forming a pipe rack. Each pipe carrier 25, 26 and 27 has an upper arm 23 and a gate mechanism 24 as illustrated for the center pipe carrier 26. The center pipe carrier 26 is oriented along a plane at a right angle to the back of the drill mast 15. In FIG. 2, it is shown in its extended position where its drill pipe 21 is aligned with the drill string 19 below and the drill head 18 above. This position of alignment shall be referred to as the drilling axis. The carriers 25 and 27 on either side are retracted from the drilling axis along planes rotated approximately 45° from the center plane and intersecting it at the drilling axis. The angle may vary in units according to the size of the mast 15 and the diameter of the drill pipes 20–22. By extending, operating and retracting the three carriers in a sequence, the three pipes 20–22 can either be moved from storage and connected in the drill string 19, or disconnected from the drill string 19 and returned to storage.

Referring to FIGS. 3 and 4, the center pipe carrier 26 is illustrated in elevation as an example of an individual pipe carrier which incorporates the present invention. The following description of the details of the center pipe carrier 26 also applies to the other two pipe carriers, except where noted. For ease of viewing, the pipe carrier 26 has been oriented vertically in FIGS. 3 and 4, but it should be understood that it would actually be tilted 30° from vertical when the mast 15 is positioned as seen in FIG. 1.

Referring to FIG. 4, the drill pipe carrier 26 is moved on upper and lower pivoting arms 23 and 28 between a retracted, storage position, and an extended position in alignment with the drilling axis. Referring again to FIG. 2, the upper arm 23 tapers from a wider, yoke-shaped back end to a narrower front end. The back end is pinned to a rotating, transverse pin 29, which is journaled in a bracket 30. The bracket 30 is bolted at the front to a cross beam 31 extending across the back of the drilling mast 15 and the bracket 30 is also bolted at the back to a mounting block 32 which supports an overhanging portion of the bracket 30 as seen in FIG. 4. Brackets 33 and 34 for the other carriers 25 and 27 are bolted to diagonal supports 35 and 36, respectively across the inside corners of the mast 15. Looking at the front end of the extended upper arm 23 in FIG. 2, there is a transverse pin 37 pivotally connecting the arm 23 to a yoke 38 having side plates seen best in FIG. 4, which are welded to opposite sides of an elongated channel member 39. The transverse pin 37 is secured by a cotter pin 37*a*.

Figure 7:
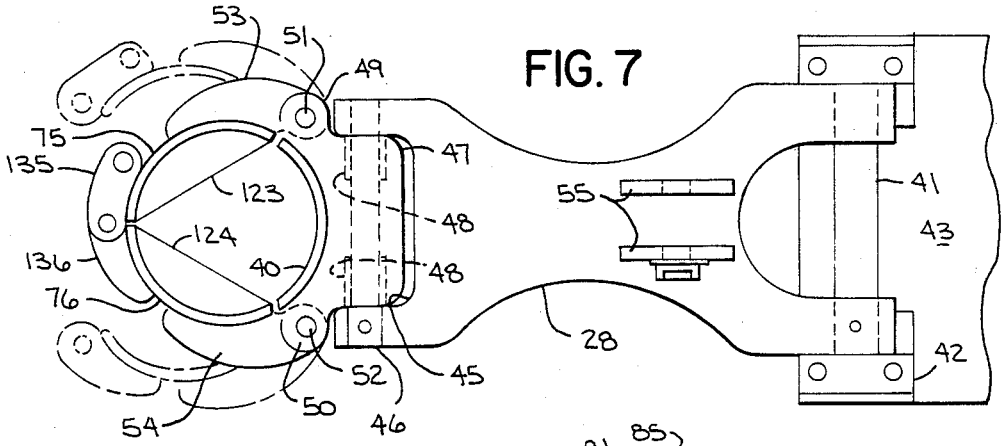
FIG. 7 is a sectional view taken in the plane indicated by lines 7—7 in FIG. 4.

Referring now to FIGS. 4 and 7, a yoke-shaped back end of the lower arm 28 is pinned to a rotating, transverse pin 41, which is journaled in a bracket 42. The bracket 42 is bolted to a support plate 43 on a drilling platform 44 near the lower end of the mast 15. As seen in FIG. 7, the yoke-shaped front end of the lower arm 28 has a gap 45 and a pin 46 extends transversely across the gap 45 and is pinned to one leg of the yoke. A coupling member 47 is mounted on bushings 48 (in phantom) to rotate on the transverse pin 46. The coupling member 47 is welded to a heel plate 40, which is mounted to the lower end of the channel member 39. The coupling member 47 extends around to opposite sides of the heel plate 40 where apertured ears 49,50 are formed. The ears 49,50 are coupled with longitudinal pivot pins 51, 52 to hinge members 53, 54 seen in FIGS. 7 and 9. Towards the back end of the arm 28 in FIG. 7 there is another bracket 55 on top of the arm 28. As seen in FIG. 4, this bracket 55 is coupled by a pin 56 to an actuating arm 57 of a hydraulic cylinder 58. When the pipe carrier 26 is in its extended position as seen in FIG. 4, the lower arm 28 rests on an upright stop 59 of T-shaped cross section that rises from the platform 44. When the pipe carrier 26 is to be retracted, the hydraulic cylinder 58 is actuated to pull in its actuating arm 57 and pull up the lower arm 28 to its position seen in phantom in FIG. 4. During this retraction, the upper arm 23 also pivots about pins 29 and 37, as seen in phantom, so that the channel member 39 remains longitudinal in the mast 15, and the arms 23 and 28 move as two opposite parallel sides of a collapsing parallelogram.

Still referring to FIG. 4, a laterally extending catch pin 60 is mounted by a flange 61 to the backside of the channel member 39. When the channel member 39 is retracted to the storage position, the catch pin 60 is first secured and later released by a latch hook 62 pivotally mounted on a flange 63 that hangs downwardly from the mast cross beam 31. This catch pin 60 is released, when the pipe carrier 26 is to be moved to its extended position, by operating a crank 64 coupled to the pivot end of the latch hook 62. The crank 64 is pivoted in a clockwise direction in FIG. 4 by the upward movement of a shaft 65 driven by a pneumatic latch actuator 66. The actuator 66 is connected through a supply line 67 to a source of pressurized air (not shown) and is interlocked with the hydraulic cylinder 58 through a control circuit to prevent actuation of the hydraulic cylinder 58 until after the catch pin 60 has been released.

As seen in FIGS. 3 and 4, an upper end of the drill pipe 21 extends above the channel member 39 and an upper extension 39*a*. As seen in FIG. 2, the shape of the channel member 39 is defined by five sides of an octagon. Within the trough of the channel member 39 are three pads 68 projecting radially inward to contact and support the drill pipe 21 at three points and prevent it from moving around the inside of the pipe carrier 26. The pads 68 are spaced at intervals of ninety degrees around the pipe 21 and the height of the pads 68 is seen in FIG. 3.

Returning to FIG. 4, each drill pipe 20–22 has a tapered, threaded tip 70 by which its upper end is coupled to the drill head 18 when being removed from its carrier, and by which its upper end is coupled to the lower end of a pipe that follows it into a hole. Below the threaded tip 70 is a neck 71 which provides a place for gripping the upper end of the pipe 21 when it is projecting just above the hole. The pipe is gripped there and loosened from a pipe above it with a break-out wrench located at the level of a drill plate 72 seen in FIGS. 3 and 4. A suitable example of such a tool is shown and described in Lang et al, U.S. Pat. No. 3,844,547 issued Oct. 29, 1974. Below its neck 71 the pipe 21 has an elongated body 73 of greater diameter than the neck 71. The body 73 of the pipe 21 extends to a lower end which is received in a receptacle 74 at the lower end of the carrier 26.

In prior pipe handling device, it was the practice to provide this receptacle in the form of an integral socket. In those devices, the pipe had to be raised to clear the socket, and the carrier had to be retracted before the lower end of the pipe could be connected to the upper end of the pipe string in the hole. In angle drilling, the upper end of the new pipe was supported by the drill head 18, but the lower end was not suitably supported due to the retraction of the carrier to its storage position.

To improve the pipe carrier for angle drilling operations, the integral socket of the prior art has been replaced with the receptacle 74 seen in FIGS. 3 and 4. As seen best in the enlarged, frontal view in FIG. 6, the receptacle 74 has left and right (as seen from the front) doors 75 and 76 which close and abut along a center line 69 in the longitudinal direction of the channel member 39. The doors 75, 76 have inwardly slanting guides 77, 78 along their upper front portions for guiding a pipe into the interior of the receptacle. These are supported by flanges 79, 80 seen on the upper front portions of the doors in FIG. 6.

The receptacle doors 75, 76 are hinged at the back as seen in FIG. 5 to pivot around upper hinge pins 81 and 82, respectively, and lower hinge pins 51 and 52, respectively. As seen in FIGS. 5 and 9, the left door 75 has a pair of rearwardly extending, longitudinally spaced hinge members 83, 85 each received between a respective pair of longitudinally spaced hinge members 87, 89 and 91, 93 on the heel plate 40. These latter hinge members 87, 89 and 91, 93 extend generally outward from the left side of the receptacle, as exemplified by member 91 in FIG. 8, so as to overlap the rearwardly extending members, as exemplified by member 85 in FIG. 8. The left hinge pin 81 extends longitudinally (relative to the pipe carrier 26) through the six hinge members 83, 85, 87, 89, 91, 93 as seen in FIGS. 5 and 9. Similarly, as seen in FIG. 5, the right hinge pin 82 extends longitudinally through six hinge members 84, 86, 88, 90, 92 and 94 to form a hinge for the right door 76. The receptacle doors 75 and 76 are actually double hinged on both the right and the left due to the connection of the coupling member 47 by the lower hinge pins 51, 52 mentioned above in regard to FIG. 7.

The receptacle doors 75 and 76 are opened and closed by actuation of a hydraulic cylinder 95 seen in FIG. 5. This cylinder 95 is hung longitudinally from a bracket 96 along the backside of the heel plate 40 on the channel member 39. Hydraulic lines 97 are connected to fittings on opposite ends of the cylinder 95 for reciprocal movement to lift up and let down an actuating rod 98. The actuating rod 98 has an eye 99 at its lower end that is received in a central opening seen in FIG. 8 where a small clevis 100 is received in an open end of a larger clevis 101. The clevises 100, 101 are pinned to the eye 99 of the actuator rod 98 and are also threadingly connected to respective eye rods 102, 103 extending to the right and left. The clevises 100, 101 are secured against rotation with adjustment nuts 127 and 128. The eye rods 102, 103 have eyes 104, 105 at their outer ends with races in which spherical cams 106, 107 are received. Hex-headed bolts 108, 109 extend through respective cams 106, 107 and into the hinge members 86, 85 on the respective doors 76, 75.

When the actuating rod 98 in FIG. 5 is pulled up by actuation of the hydraulic cylinder 95 the outer ends of the eye rods 102, 103 are pulled together as their centrally connected ends are lifted. The hex-head bolts 108, 109 provide levers by which the doors 75, 76 are pivoted about their hinge pins 51, 52, 81, 82 to cause them to swing laterally and open as seen in phantom in FIG. 7. When the hydraulic cylinder 95 is actuated to move in the other direction, the actuating rod 98 moves down to push the outer ends of the eye rods 102, 103 apart and to pivot the doors 76, 75 to close. During these operations, the spherical cam joints provide a mechanism for translating the linear motion of the actuating rod 98 to the circular motion required of the bolts 108, 109 as door levers. This particular arrangement of the door actuator 95 and its folding actuating linkage is seen to provide an advantage in its compact arrangement along the back of the receptacle.

Figure 8:
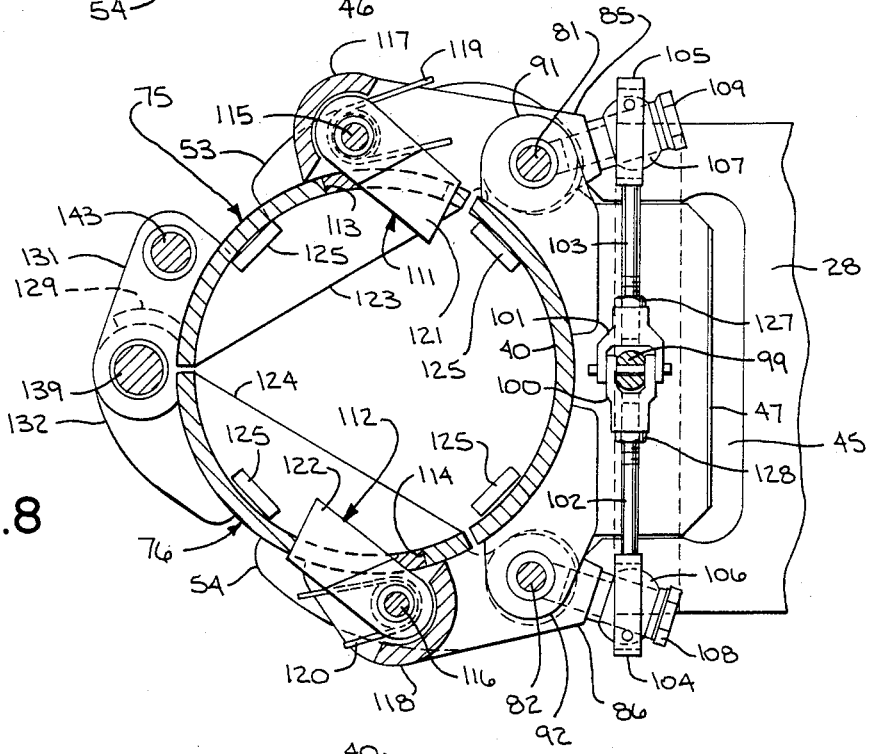
FIG. 8 is a sectional view taken in the plane indicated by line 8—8 in FIG. 4.
Figure 9:
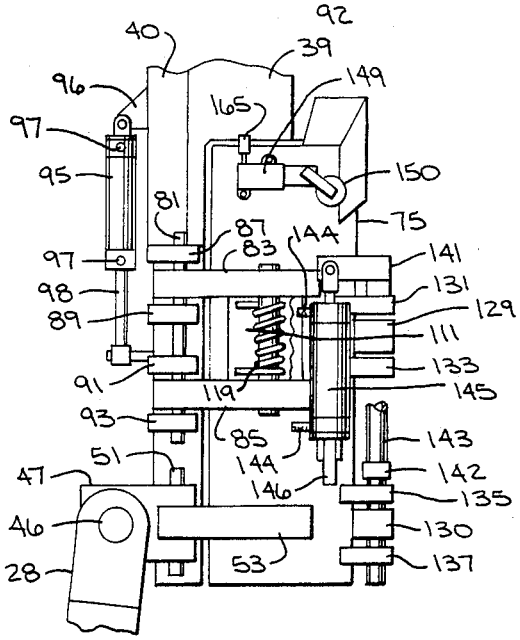
FIG. 9 is a left side view of the receptacle at the lower end of the pipe carrier shown in FIG. 4.

Referring next to FIGS. 8 and 9, the doors 75 and 76 carry respective pawls 111, 112 which project through windows 113, 114 into the interior of the receptacle 74. The pawls 111, 112 are mounted to pivot on pins 115, 116 which extend longitudinally between respective pairs of hinge members 83 and 85, and 84 and 86, respectively. Curved members 117, 118 extend between the respective pairs of hinge members 83 and 85, and 84 and 86, along the outside of the pawls 111, 112 to partially shield them and to provide a stop for one end of a torsion spring 119, 120 coiled around each pin 115, 116. When a pipe is lowered into the receptacle, or when the doors 75, 76 are closed around the lower end of the pipe, the pawls 113, 114 are urged outward against opposite ends of the torsion springs 119, 120. The pawls 111, 112 have beveled surfaces 121, 122 extending into the interior of the receptacle. When a pipe is being lowered into a closed receptacle, it contacts these surfaces 121, 122, and then slides in between the pawls 121, 122, forcing them apart. The bottom of the pipe is supported by webs 123, 124 which extend laterally along the inside of the doors 75, 76 at a level below the pawls 111, 112 and even with the lower hinge members 53, 54. In this position the turning of the pipe will present niches (not shown) which allow the pawls 111, 112 to move forward, engage the lower end of the pipe and block its rotation in one direction. By applying torque through the drill head 18 in a direction in which the lower end of the pipe is blocked, the connection between the upper end of the drill pipe and the drill head 18 is conveniently loosened and undone. Also seen in FIG. 8 are four pads 125 projecting radially inward from the inside walls of the receptacle at ninety degree intervals to support the pipe against lateral movement.

Referring next to FIG. 6, there is a locking mechanism which crosses the longitudinal center line 69 where the front ends of the doors 75 and 76 meet. On the left door 75, there are an upper pair of lugs 131, 133 and a lower pair of lugs 135, 137. All of these lugs 131, 133, 135 and 137 extend laterally across the center line 69 when the doors are closed. The upper pair of lugs 131, 133 is spaced from the lower pair of lugs 135, 137 in the longitudinal direction of the pipe carrier 26. Within each pair of lugs, the upper lug 131, 135 is spaced longitudinally from the lower lug 133 and 137, respectively. The general shape of these lugs is illustrated by lug 131 in FIG. 8 and lug 135 in FIG. 7.

Returning to FIG. 6, on the right door 76 are upper and lower lugs 132, 136 which extend laterally across the centerline when the doors 75 and 76 are closed and which are interposed between adjacent lugs in a respective pair of lugs 131, 133 and 135, 137 on the left door 75. The ends of the lugs 132, 136 are received against curved stops 129, 130, as seen somewhat better in phantom in FIG. 8. The lugs 132, 136 on the right door 76 have apertures which become aligned with apertures in the lugs 131, 133, 135 and 137 on the left door 75 when the doors 75 and 76 are shut. A pair of longitudinally extending pins 139 and 140 slide down into the apertures of the respective sets of lugs, 131–133 and 135–137 to secure the doors 75 and 76, and the pins 139, 140 slide up and out of the apertures to release the doors 75 and 76. The pins 139 and 140 are carried by cross members 141 and 142 which extend laterally over and above upper lugs 131, 135 respectively in each respective set of lugs. The cross members 141, 142 are linked together by a shaft 143 extending longitudinally (relative to the pipe carrier 26) through the lugs 131, 133, 135, 137 on the right door 75. The shaft 143 is moved up to slide the pins 139, 140 to the release position and the shaft 143 is moved down to slide the pins 139, 140 to the secure or locking position.

The locking mechanism also includes an actuator, which is preferably a hydraulic cylinder 145 mounted on the left door 75. The hydraulic cylinder 145 extends longitudinally of the door 75 and the carrier 26, being connected and supported at its lower end by a flange 146 on the left door 75 and having an actuating rod 147 at its upper end reaching up and being pinned to one end of the upper cross member 141 that extends to the left of the shaft 143. The hydraulic cylinder 145 is connected by a pair of hydraulic lines 144 (seen partially in FIG. 9) to a source of pressurized hydraulic fluid. As is well known, such a cylinder 145 includes a piston, which responds to an increase in pressure in the lower line over the pressure in the upper line to move upwardly, and which responds to greater pressure in the upper line to move downwardly. When the piston moves up, it moves the lock pins 139, 140 up to unlock the doors 75, 76 and when it moves down, it reinserts the lock pins 139, 140 to secure the doors 75, 76.

Also seen on the left door 75 in FIG. 6, above the hydraulic cylinder 145, is an air valve 149 which is actuated by a cam follower 150. When the cross member 141 is moved to its uppermost position it moves up against the cam follower 150 to open the valve 149. Referring to FIG. 5, the valve 149 is connected between a supply line 151 providing pressurized air and a line 152 running to the lower end of a pneumatic cylinder 153. This cylinder 153 is mounted on the extension **39*a* of the channel member 39 and connects to actuate the gate mechanism 24 when the receptacle 74** is unlocked.

Referring again to FIG. 2, the gate mechanism 24 includes an L-shaped gate member 154 which pivots between a closed position illustrated by the right pipe carrier 27 to an open position illustrated by the center pipe carrier 26. In the open position the free leg of the gate member 154 moves up and to the right side of the channel member 39 against a stop 148. The pipe 21 will then clear the gate 24 when the carrier 26 is retracted to its storage position. The other leg of the gate member 154 has a hinge portion that mates with a complementary hinge support 155 on the right side of the channel member 39. A gate hinge pin 156 extends from front to back along the right side of the channel member 39 to pivotally mount the gate member 154.

Referring now to FIG. 5, the pneumatic cylinder 153 has an actuating shaft 159 that extends down through the coils of a return spring 157 to a compressing flange 158 and a pinned connection to the gate member 154. This connection is inside the gate hinge pivot pin 156, so when the cylinder 153 receives sufficient compressed air, the shaft 159 is raised to compress the return spring 157 and pivot the gate member 154 upward. When the air valve 149 is closed to interrupt the supply of pressurized air, air is exhausted back through the air line 152 and out of a muffler (not shown in FIG. 5) attached to the valve 149. The return spring 157 then forces the flange 158 and the actuating shaft 159 to their extended positions to pivot the gate member 154 to its closed position.

Figure 10:
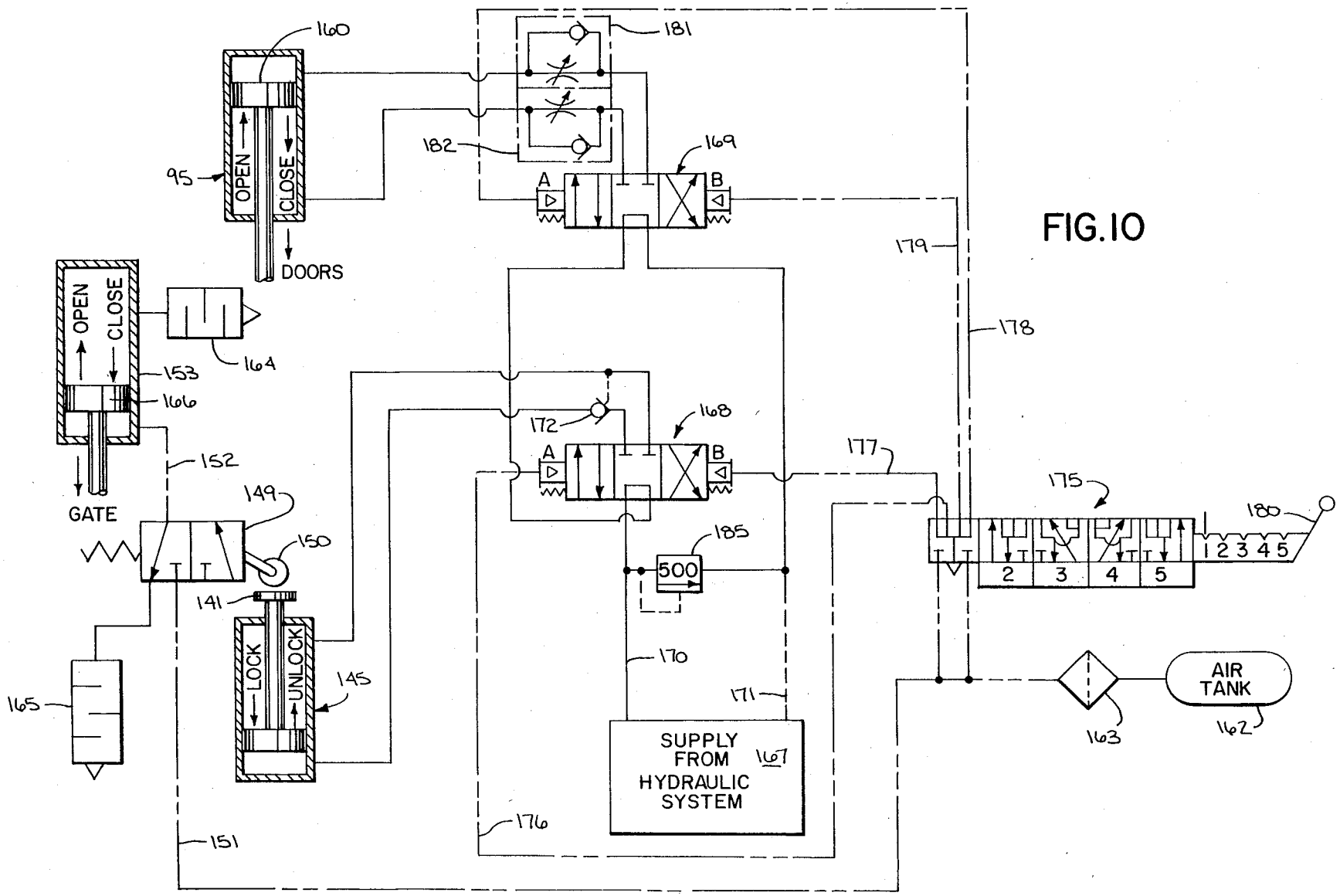
FIG. 10 is a schematic diagram of the fluid circuitry used to control the moving parts of the pipe carrier of FIG. 4.

FIG. 10 shows a schematic of a control circuit that interlocks the operation of the actuators for locking the receptacle lock and opening the gate 154. This circuit also controls the opening and closing of the receptacle doors 75, 76. At the upper left in FIG. 10 is the hydraulic cylinder 95 that was seen earlier in FIG. 5. The hydraulic cylinder 95 has a piston 160 that moves upwardly to actuate the opening of the doors 75, 76 and downwardly to actuate the closing of the doors 75, 76. In the lower left in FIG. 10 is the hydraulic cylinder 145 for locking and unlocking the locking mechanism described earlier in relation to FIG. 6. This cylinder 145 also has a piston 161, which moves up to unlock the doors 75, 76 and down to lock the doors 75, 76. The flange above the upper end of this cylinder 145 represents the member 141 that engages the cam follower 150 on the air valve 149.

The air valve 149 is connected to an air tank 162 which supplies pressurized air through an air filter 163 to a lower port on the air cylinder 153. The upper port of this cylinder 153 is connected to a muffler 165. The air valve is also connected to a muffler 165. In the position of the valve 149 seen in FIG. 10, air flows back through the pneumatic line 152 and through the air valve 149 to the muffler 165, while the stream of pressurized air is blocked. When the cam follower 150 is actuated by the upward movement of the piston 161, a spool in the air valve 149 is moved to the left against a return spring to connect the supply of pressurized air to the lower port on the air cylinder 153 causing the air cylinder piston 166 to move upward and open the gate mechanism as discussed earlier. As the piston 166 moves upward, air is exhausted through the muffler 164 connected to the upper port. When the piston 161 in the hydraulic cylinder 145 moves down to lock the receptacle doors 75, 76 the spool in the air valve 149 is returned to the position in FIG. 10 by the force of the spring and air is exhausted back through the valve 149 and the muffler 165 allowing the piston 166 in the air cylinder 153 to move downward and close the gate mechanism.

The hydraulic cylinders 95, 145 receive pressurized hydraulic fluid from a main hydraulic system that is represented by the block 167 in FIG. 10. This supply is connected in series to a pair of four-port, three-position hydraulic valves 168 and 169 via a main pressure line 170 and a return line 171.

In FIG. 10 the spool of each of the hydraulic valves 168, 169 is in its off position in which pressurized fluid on the supply side of the valves 168, 169 is blocked from the ports on the output side of the valves 168, 169. In this position fluid is circulated from the first valve 168 to the second valve 169 and then back to the supply 167 via the return line 171.

When the spool in each valve 168, 169 moves to the right against a return spring, the main pressure line 170 is connected to the line running to the lower port on each of the hydraulic cylinders 95, 145, and the return line 171 is connected to a line from an upper port on each of the hydraulic cylinders 95, 145. Looking first at the cylinder 145 for the locking mechanism, pressurized fluid would pass through a check valve 172 and move the piston 161 upward to unlock the receptacle doors 75, 76 and actuate the opening of the gate mechanism. The check valve 172 maintains pressure in the line and keeps the locking pins 139, 140 raised until positive action is taken to actuate their movement to the locking position. When pressure is increased through the line gotil positive action is taken to actuate their movement to the locking position. When pressure is increased through the line going to the upper port on this hydraulic cylinder 145 there is an opening of the check valve 172, this response being represented by the dashed line in FIG. 10, which allows pressure in the line to drop and which allows the piston 161 in the cylinder 145 to move downward. The movement of the spool in this hydraulic valve 168 is controlled by air pressure at pneumatic inputs A and B. Thus, a pneumatic pressure signal at input A results in the unlocking of the receptacle doors 75, 76. The removal of this signal will not result in the locking of the doors 75 and 76, because this requires a positive signal at the B pneumatic input.

When the other hydraulic valve 169 is moved to the right, the main pressure line 170 is connected to the lower port on the hydraulic cylinder 95 to open the previously unlocked receptacle doors 75, 76. The hydraulic valve 169 also has A and B pneumatic inputs. A positive signal at the A pneumatic input causes the opening of the doors 75 and 76, which will remain open until a positive signal is received at the B input. The mere removal of the signal at the A input will not cause the doors to close.

The signals to the A and B pneumatic inputs on the hydraulic valves 168, 169 are controlled by a manually operated, five-position pneumatic valve 175, which is seen in FIG. 10 and which is located in the cab 11 of the drilling unit 10 seen in FIG. 1. Two pneumatic lines 176, 177 run to the A and B pneumatic inputs, respectively, on the first hydraulic valve 168, and two more pneumatic line 178, 179 run to the A and B pneumatic inputs, respectively, on the second hydraulic valve.

The pneumatic control valve 175 has two inlet ports and one exhaust port. In the first position, the valve 175 blocks air to all four of the pneumatic lines 176–179 running to the hydraulic control valves 168, 169. This is the "off" position.

In a second position pressurized air is supplied to the B pneumatic input on the first hydraulic valve 168. This is the position in which the locking mechanism is actuated to its locked position and the gate 154 is closed.

In the third position of the pneumatic valve 175, pressurized air is supplied to the pneumatic line 176 coupled to the A pneumatic input on the first hydraulic valve 168. In this position, the doors 75, 76 are unlocked and the gate 154 is opened. Thus, it will be observed that the operator 180 is moved through the locked position to reach the unlocked position, and this is a sequence for preventing the doors from being unintentionally unlocked.

In the fourth position of the pneumatic valve 175, pressurized air is routed through the pneumatic line 179 to the B pneumatic input on the second hydraulic valve 169 which closes the receptacle doors 75, 76.

In the fifth position of the pneumatic valve 175, pressurized air is routed to the A pneumatic input on the second hydraulic valve 168 to open the doors 75, 76. It will therefore be observed that the manual valve operator 180 must be moved through the fourth position closing the doors 75, 76 before it can reach the fifth position opening the doors, thereby preventing the doors from being opened prematurely.

It is desired that the door opening and closing movement be slower and more gradual than the locking and unlocking of the doors. To provide a different speed of operation for the door opening and closing cylinder 95, adjustable orifices 181, 182 are connected in the hydraulic lines from the second hydraulic valve 169 to the cylinder 95. These orifices 181, 182 are adjusted to further limit the flow provided by the main hydraulic system 167. The orifices 181, 182 also function as check valves that prevent backflow and maintain pressure in the lines to the cylinder 95. The pressure of the hydraulic subsystem in FIG. 10 is limited to 500 p.s.i. by a pressure compensating valve 185 connected across the supply and return lines 170 and 171 from the main hydraulic system 167.

Figures 11, 12, 13, 14, 15, 16, 17, 18, 19:
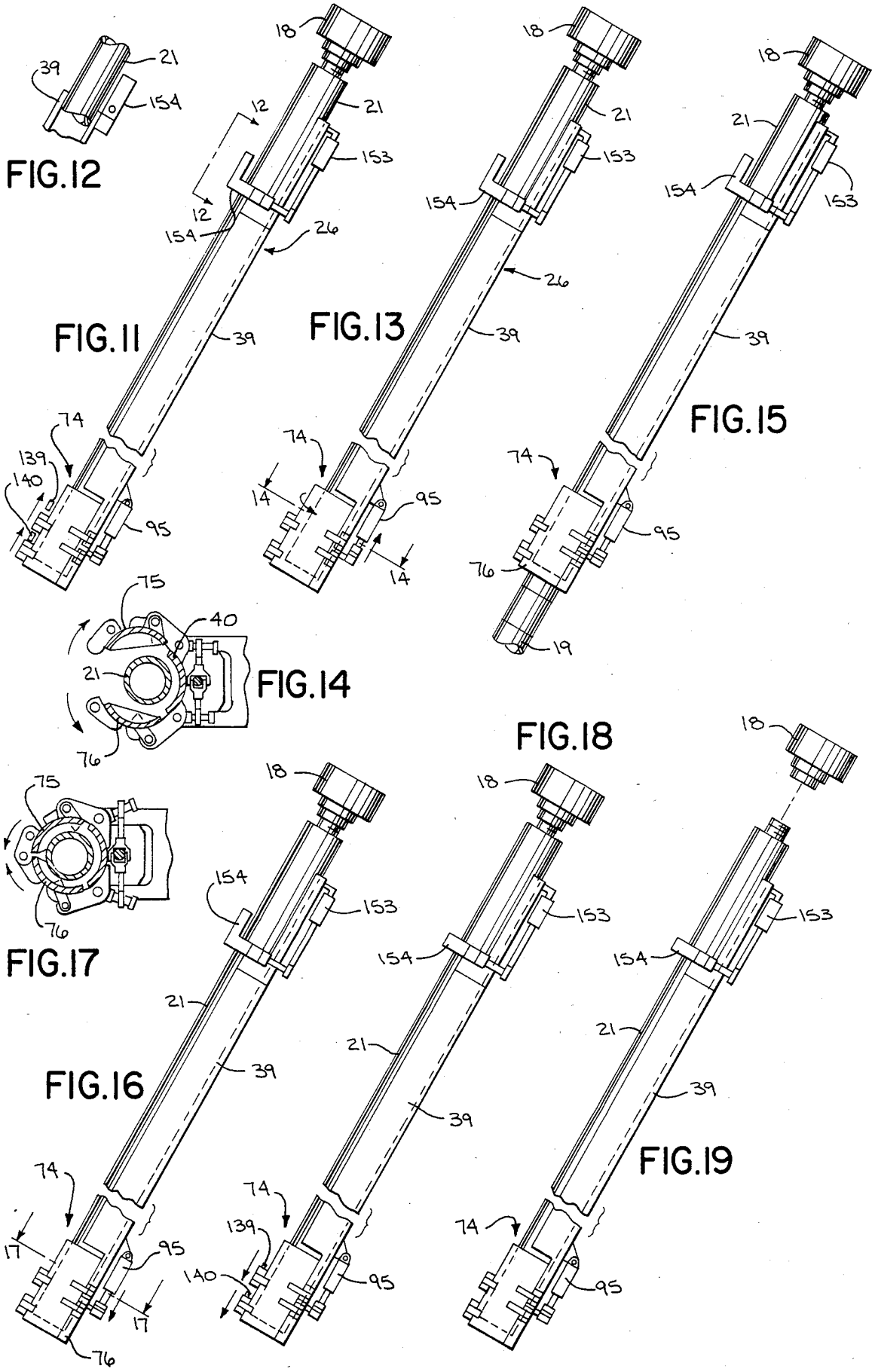
FIGS. 11–19 are a series of schematic figures showing a sequence of operations for the pipe carrier of FIG. 3.

Thus far, the mechanical elements of the pipe carriers 25, 26 and 27 and their actuators have been described. The invention also relates to a sequence of operation which applies to the apparatus herein and which can be applied to other apparatus as well. Referring to FIGS. 11–15, the sequence of operation in connecting a pipe to the drill string at an angle is shown. In FIG. 11 the drill pipe 21 is supported along its backside with its lower end extending into the receptacle 74 as shown in phantom. In FIG. 11 the carrier 26 has been extended to align the pipe 21 with the drilling axis and the drill head 18 has been connected to the upper end of the pipe 21. The receptacle is then unlocked as represented in FIG. 11 by the upward movement of the locking pins 139, 140. At about the same time (allowing for the response time of the pneumatic cylinder 153) the gate 154 is flipped open and this is seen somewhat better in the detail view FIG. 12.

The next step is seen in FIGS. 13 and 14 where the doors 75, 76 are opened. As an optional step the pipe 21 is raised about one inch between the unlocking step and the opening step. After the doors 75, 76 are opened the drill head 18 is brought down in FIG. 15 to lower the pipe 21 to the string 19, where it is turned onto the string while still being supported in the trough of the channel member 39. Lastly, the drill pipe carrier 26 is retracted to the storage position, where preferably the doors 75, 76 of the receptacle 74 are closed and locked so as to be out of the way of the other carriers 25, 27. From the description of this sequence it can be seen how the pipe carrier of the present invention provides an advantage over prior constructions in permitting support of the pipe 21 as it is lowered and connected to the drill string 19.

Referring next to FIGS. 16–19, there is shown a sequence in which an individual pipe 21 is disconnected from the drill string 19. In several preliminary steps, the carrier 26 is unlocked and opened and is moved into position to support the uppermost pipe 21 in the string 19. The lower end of the pipe 21 is disconnected from the drill string 19 using the break-out wrench referred to earlier. The pipe 19 is then raised by the drill head 18 while being supported in the trough of the channel member 39. The pipe 21 is raised from one to two inches above the webs (not shown) in the lower end of the receptacle 74.

As seen in FIGS. 16 and 17 the doors 75, 76 are then actuated to close around the pipe 21. Next, as shown in FIG. 18, the locking mechanism is operated by reinsertion of the locking pins 139, 140 and the gate 154 is closed at nearly the same time. While the gate 154 follows the operation of the locking mechanism, the time interval of this response is so short that the gate 154 can be considered to be operated at nearly the same time as the locking mechanism and as part of the same step. The receptacle doors 75, 76 lock around the lower end of the pipe 21, and the pawls described earlier are then in position to engage the lower end of the pipe 21 and block its rotation in one direction. The last step in FIG. 19 is therefore to loosen and disconnect the drill head 18 from the upper end of the drill pipe, and this can be done by applying torque to the rotatable coupling on the drill head 18 in the direction in which the pawls block movement of the pipe 21. As the pipe 21 is unthreaded from the coupling, the advance of the thread causes the pipe 21 to settle down the final one to two inches onto the webs in the receptacle.

These methods include a two-step closing and locking operations where the locking operation secures the receptacle 74 prior to connection and disconnection of the drill pipe 21 and the drill head 18. The result is a carrier which supports pipes for angle drilling while retaining the functions provided by the integral sockets of the prior pipe carriers. Having disclosed both the apparatus and use of the invention, the following claims are made.

We claim:

1. A drill pipe handling mechanism of a type usable in a pipe rack on a mobile earth drilling unit and cooperable with a drill head, the mechanism comprising:

an elongated channel member mounted longitudinally in the rack to move between a retracted, storage position and an extended position where a pipe is connected to, and disconnected from, the drill head, the channel member having a trough in which a backside of the drill pipe is supported;

a closure at a lower end of the channel member, the closure including a pair of doors and the closure supporting a lower end of the pipe when the doors are closed, the doors having respective back portions pivotally mounted at the lower end of the channel member and having front portions that may be opened apart or closed together by pivoting the doors, the doors having respective lugs extending laterally along outer sides of their front portions wherein lugs on one door are interposed between adjacent lugs on the other door when the doors are closed, the doors carrying pawl means inside to oppose rotation of a lower end of the pipe in one direction;

securing means mounted on one of the doors for movement into and out of a position coupling the interposed lugs with the adjacent lugs and securing the doors against opening when the drill head is loosened from the pipe by rotation in the direction in which the pawl means opposes rotation of the pipe;

a first fluid-driven actuator carried by one of the doors and coupled for actuating the movement of the securing means into and out of its position coupling the interposed and adjacent lugs; and a second fluid-driven actuator mounted along a backside of the channel member and coupled to pivot the doors to open and close when the securing means is out of its position coupling the interposed and adjacent lugs.

2. The drill pipe handling mechanism of claim 1 wherein:

the first fluid-driven actuator moves with the securing means;

further comprising a valve that is opened in response to the movement of the first fluid-driven actuator;

further comprising a gate mounted near the upper end of the channel member to move between a closed position in front of the trough and an open position to one side of the trough which allows the pipe to clear the gate; and further comprising a third fluid-driven actuator mounted along the backside of the channel member, coupled to the gate and connected in a fluid circuit with the valve, the third fluid-driven actuator being responsive to the opening of the valve to move the gate from its closed position to its open position at about the same time as the lugs on the doors are uncoupled.

3. The drill pipe handling mechanism of claim 2, wherein:

the first fluid-driven actuator has an actuating rod that moves with the securing means;

wherein the valve is an air valve with a cam-following actuator that is moved by the actuating rod when the valve is opened; and wherein the third fluid-driven actuator is an air-operated cylinder that responds to pressurized air passed to it from the open valve.

4. The drill pipe handling mechanism of claim 1, wherein:

the first fluid-driven actuator is a hydraulic cylinder; and wherein the second fluid driven actuator is a hydraulic cylinder.

5. The drill pipe handling mechanism of claim 4, further comprising:

a first air-actuated hydraulic control valve coupling the first hydraulic cylinder to a source of pressurized fluid;

further comprising a second air-actuated hydraulic control valve coupling the second hydraulic cylinder to the source of pressurized fluid; and further comprising a five-position, operator-controlled air valve coupling air-actuating portions of the hydraulic control valves to a source of pressurized air, wherein in a first position air is blocked from passage to the hydraulic control valves and the hydraulic cylinders are deactuated, in a second position pressurized air is coupled to actuate the first hydraulic control valve to couple hydraulic fluid to one end of the first hydraulic cylinder so that the securing means is moved to its position coupling the interposed and adjacent lugs, in a third position pressurized air is coupled to actuate the first hydraulic control valve to couple hydraulic fluid to another end of the first hydraulic cylinder so that the sensing means is moved out of its position coupling the interposed and adjacent lugs, in a fourth position pressurized air is coupled to actuate the second hydraulic control valve to couple hydraulic fluid to one end of the second hydraulic cylinder to actuate the closing of the doors, and in a fifth position pressurized air is coupled to actuate the second hydraulic control valve to couple hydraulic fluid to another end of the second hydraulic cylinder to actuate the opening of the doors.

6. The drill pipe handling mechanism of claim 1, wherein each door has its respective back end mounted at the lower end of the channel member independently of the other door, so that the doors are double-pivoted.

7. The drill pipe handling mechanism of claim 1, wherein the second fluid-driven actuator is coupled to the doors by a folding linkage having opposite ends pivotally connected to the respective doors and having a central pivot connected overhead to the second fluid-driven actuator, the linkage being lifted to bring its ends closer together and to pivot the doors open and the linkage being moved downward to spread its ends further apart and to pivot the doors to close.

8. A locking mechanism for securing first and second laterally swinging, longitudinally extending doors that pivot to open and close a receptacle at a lower end of a drill pipe carrier, the mechanism comprising:

upper and lower pairs of the lugs extending laterally along the outside of the first door, the upper and lower pairs being spaced longitudinally on the first door, and within each pair, the lugs being longitudinally spaced from each other;

upper and lower lugs extending laterally along the outside of the second door, the upper lug extending between the upper pair of lugs on the first door when the doors are closed, and the lower lug extending between the lower pair of lugs on the first door when the doors are closed, the lugs on the first door and the second door having apertures which become aligned when the doors are closed;

an upper cross member extending laterally above the upper pair of lugs on the first door, and a lower cross member extending laterally above the lower pair of lugs on the first door, each cross member carrying a respective pin that is received in the apertures of the lugs immediately below it when the doors are closed;

a shaft mounted for longitudinal movement on the first door, the shaft being connected to the cross members for moving the pins into and out of a position where the pins are received in the apertures of the respective lugs to secure the doors; and a fluid-driven actuator carried on the first door and coupled to the shaft to move the shaft longitudinally in response to actuation from an external source of pressurized fluid.

* * * * *